US006688561B2

(12) United States Patent
Mollet et al.

(10) Patent No.: US 6,688,561 B2
(45) Date of Patent: Feb. 10, 2004

(54) REMOTE MONITORING OF GRADE CROSSING WARNING EQUIPMENT

(75) Inventors: Samuel R. Mollet, Grain Valley, MO (US); Anthony F. Colucci, Overland Park, KS (US); Augustus Henry Brown, Kearney, MO (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/173,491

(22) Filed: Jun. 17, 2002

(65) Prior Publication Data

US 2003/0122039 A1 Jul. 3, 2003

Related U.S. Application Data

(60) Provisional application No. 60/344,000, filed on Dec. 27, 2001.

(51) Int. Cl.[7] ..... B61L 29/00
(52) U.S. Cl. ..... 246/473.1
(58) Field of Search ..... 246/423 R, 473.1, 246/473.3, 476, 111, 112, 114 R, 115, 117

(56) References Cited

U.S. PATENT DOCUMENTS 3,929,307 A * 12/1975 Geiger ..... 246/130
4,108,405 A * 8/1978 Gibson ..... 246/125
4,711,418 A 12/1987 Aver, Jr. et al.
5,022,613 A * 6/1991 Peel ..... 246/125
5,098,044 A 3/1992 Petit et al.
5,496,003 A * 3/1996 Bernard ..... 246/29 R
5,554,982 A * 9/1996 Shirkey et al. ..... 340/903
5,785,283 A * 7/1998 Ehrenberger et al. ..... 246/62
5,954,299 A * 9/1999 Pace ..... 246/293
5,995,881 A 11/1999 Kull
6,032,905 A 3/2000 Haynie
6,157,322 A 12/2000 Anderson
6,267,332 B1 * 7/2001 Almblad ..... 246/294

* cited by examiner

*Primary Examiner*—S. Joseph Morano
*Assistant Examiner*—Robert J. McCarry, Jr.
(74) *Attorney, Agent, or Firm*—Carl Rowold; David G. Maire; Beusse Brownlee Wolter Mora & Maire, P.A.

(57) ABSTRACT

A system (40) and method for remotely monitoring the operating status of railroad grade crossing warning equipment. A sensor (46) generates a signal (48) responsive to the operation of a grade crossing annunciator (42). In one embodiment, the annunciator may be a bell or speaker horn (92) and the sensor may be an accelerometer (99) mechanically coupled to the bell. A wayside controller (52) uses the signal as input for developing information (70) indicative of the operating status of the annunciator. A communications link (74) transmits the information to a location remote from the grade crossing. A system controller (78) located at the remote location may diagnose the information to direct a maintenance center (82) and/or operations center (86) in response to an indication of degraded performance of the annunciator. The communications link may include the Internet and may be used for two-way communication between the remote location and the grade crossing location (22).

28 Claims, 3 Drawing Sheets

REMOTE MONITORING OF GRADE CROSSING WARNING EQUIPMENT

This application claims benefit of the Dec. 27, 2001, filing date of U.S. provisional patent application No. 60/344,000.

FIELD OF THE INVENTION

This invention relates generally to the field of rail transportation, and more particularly to monitoring and reporting of the status of grade crossing warning equipment.

BACKGROUND OF THE INVENTION

Railroad systems include wayside equipment such as switches, signals, and vehicle detectors including hot wheel detectors, dragging equipment detectors, high/wide load detectors, vehicle identification systems, etc. Such equipment must necessarily be located throughout the railroad system, and is thus geographically dispersed and often located at places that are difficult to access. Systems are currently in use for communicating operational and status information relating to the condition of the train or the track to control centers through various types of modems. For example, position indicators are provided on switches and a signal responsive to the position of a switch is communicated to a control center for that section of track.

Grade crossings where streets and railroad tracks intersect are notorious for collisions between roadway and rail vehicles. Various types of warning systems are used to alert pedestrians and roadway vehicle operators to the presence of an oncoming train. Passive warning systems include signs and markings on the roadway that indicate the location of the crossing. Active warning systems include the audible signal from a locomotive horn and various types of wayside warning devices. Grade crossing warning devices are activated by an approaching train and may include visual and audible alarms as well as physical barriers. A typical crossing in an urban area may include signs painted onto the roadway and/or erected at the crossing and a fully automatic gate with lights and bells for blocking all lanes of roadway traffic.

Grade crossing warning systems are subject to normal equipment reliability concerns. The proper operation of such equipment is important to the safe and reliable operation of the railroad. In order to reduce the probability of equipment failures, routine maintenance and inspections are performed on grade crossing warning equipment. An inspector will visit the site of each crossing periodically to inspect the equipment and to confirm its proper operation. Unexpected failures may occur in spite of such efforts, and such failures may remain undetected for a period of time.

Due to the limited field of view from a locomotive and the great inertia of a moving train, it is not possible to rely on a train operator to stop a train in the event that there is an object blocking the track at a grade crossing. Thus it is vitally important to ensure that the grade crossing equipment is operating properly. While the periodic inspection and maintenance program described above does provide a high degree of assurance, efforts continue to further improve the reliability of grade crossing warning equipment and to further facilitate the detection of equipment failures when they do occur. U.S. Pat. No. 5,098,044 describes one such system for communication between a train and the grade crossing protection equipment to ensure that the protection equipment receives a signal that the train is approaching. This system will automatically apply the brakes of the train in the event that communication between the train and the grade crossing equipment is not confirmed. However, even if the crossing equipment does receive a train-approaching signal, there may be a failure that prevents the warning equipment from providing a proper alert to the roadway users. Such failure may remain undetected until the date of the next periodic inspection.

U.S. Pat. No. 6,157,322 describes an automated crossing warning system that eliminates the need for the sounding of the locomotive horn. This system provides a horn warning to roadway vehicle operators from horns located at the crossing and specifically oriented toward the roadway, thereby reducing the disturbance to local residents. A horn detector is provided to operate a strobe light visible from the approaching train when the horn is operating above a predetermined decibel level. In the event that the strobe light is not flashing, the engineer of the locomotive will sound the locomotive horn to provide a warning of the approaching train. However, this system does not provide a mechanism for the reporting of such failures. In this system, the train operators will continue to operate their respective locomotive horns until the failure is repaired during the next periodic inspection.

U.S. Pat. No. 5,785,283 describes a system and method for communicating operational status of train and track detecting wayside equipment to a locomotive cab. This system is directed to the reduction of radio congestion in the VHF radio system used to communicate between the wayside equipment and the locomotive. This system is described as being used for monitoring or reporting the status of grade crossing warning systems.

SUMMARY OF THE INVENTION

Thus, a system for remote monitoring and reporting of the readiness status of railroad grade crossing warning equipment is desired.

An apparatus for monitoring railroad grade crossing warning equipment is described herein as including: circuitry for activating an annunciator at a grade crossing location in response to the approach of a train; a sensor for generating a signal responsive to the operation of the annunciator; circuitry responsive to the signal for generating information representing an operating status of the annunciator; and a communications link for communicating the information to a location remote from the grade crossing. The annunciator may be a sound-producing device, and the sensor may be an accelerometer. The apparatus may further include: a mounting bracket attached to the sound producing device; a circuit board attached to the mounting bracket and including circuitry for operating the sound producing device; the accelerometer being attached to the circuit board; signal processing circuitry associated with the accelerometer mounted on the circuit board; and a mounting device for attaching the mounting bracket to a support and for providing isolation at frequencies equal to or greater than a center frequency of sound produced by the sound producing device. The apparatus may further include: a database for receiving and storing the information; and a data processor associated with the database for processing the information.

An apparatus for monitoring a railroad grade crossing warning bell is described herein as including: an accelerometer mechanically coupled to a railroad crossing warning bell for receiving mechanical vibrations produced by the bell and for producing a signal responsive to the vibrations; and a controller for receiving the signal and for developing information regarding an operating status of the bell.

A method of monitoring railway grade crossing warning equipment is described herein as including: installing a sensor at a grade crossing location proximate a grade crossing warning annunciator, the sensor adapted to produce a sensor signal responsive to operation of the annunciator; processing the sensor signal to produce information responsive to an operating status of the annunciator; and transmitting the information to a location remote from the grade crossing location. The information may be communicated via a multi-media communication network.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
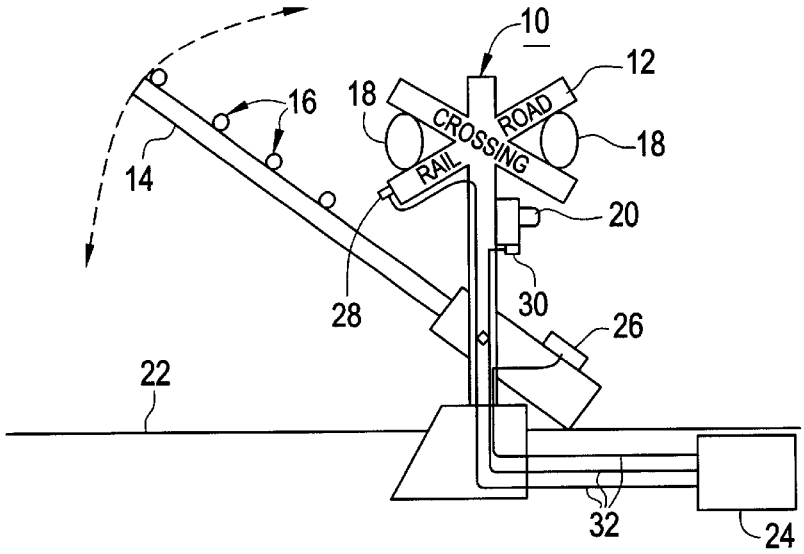
FIG. 1 is an elevation view of a railroad grade crossing signal post including a moveable gate, lights and a bell with associated sensors and wayside equipment box.

A railroad grade crossing signal post 10 is shown in FIG. 1 as including a sign 12 having the familiar cruciform shape, a swing gate 14 with attached lamps/reflectors 16, warning lights 18 and alarm bell 20. The position of the gate 14 and the operational status of the lamps/reflectors 16, warning lights 18 and alarm bell 20 are controlled in response to the proximity of a rail vehicle to the grade crossing 22. As is known in the art, the gate 14 is moved to a horizontal position and the lamps 16, warning lights 18 and bell 20 are all activated to block road vehicle traffic and to warn pedestrians and road vehicle operators of an approaching train. A wayside equipment box 24 may be used to house the power and control components necessary for the operation of the various components of the signal post 10. Associated equipment may be located along the track 22 in either direction for sensing the approach of a train and for initiating a warning configuration of the signal post 10.

A plurality of sensors is provided for detecting the proper operation of the various components of the signal post 10. A position sensor 26 is attached to the swing gate 14 for detecting when the gate 14 is in its upright and lowered positions. Position sensor 26 may take the form of a mercury level switch, one or more limit switches, an ultrasonic or infrared sensor, a potentiometer, or any other type of device useful for determining the position of the gate 14. A photo sensor 28 is located proximate warning light 18 for detecting when light 18 is emitting a predetermined pattern of light energy. A sound detector 30 is located proximate bell 20 for detecting when bell 20 is emitting a predetermined pattern of sound energy. Each of these sensors may be connected to associated power supplies, converters, amplifiers, etc. located in equipment box 24 via respective cables 32.

Figure 2:
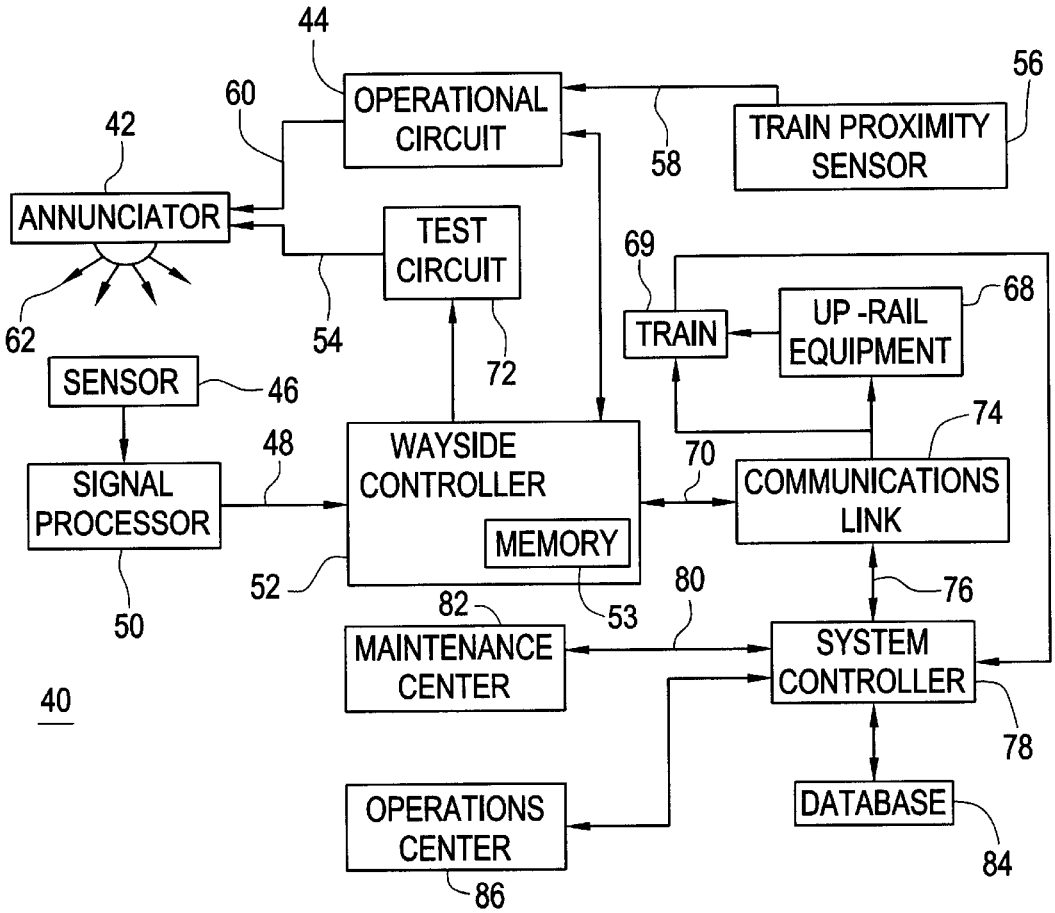
FIG. 2 is a functional diagram of a grade crossing warning system including remote readiness monitoring.

The components illustrated in FIG. 1 form part of a grade crossing equipment monitoring system 40, which is further illustrated in the functional diagram of FIG. 2. A grade crossing annunciator 42 may be any of those known in the art, such as swing gate 14, lamp/reflector 16, warning light 18 or alarm bell 20. An operational circuit 44 for delivering a warning of an approaching rail vehicle controls the annunciator 42. A train proximity sensor 56 is located along a rail line to sense the approach of a rail vehicle to a grade crossing location. Upon receipt of a train proximity signal 58 from train proximity sensor 56, the operational circuit 44 provides an alarm signal 60 to annunciator 42. Annunciator 42 functions to emit a predetermined output 62, such as sound emitted from a bell or light emitted from lamp 16 or tilting movement of gate 14. A sensor 46 is used to detect the output 62 of annunciator 42 and to provide a sensor signal 48 responsive to the operation of the annunciator 42. A signal processor 50 such as an amplifier, filter, converter, etc. may be used to place sensor signal 48 in a form suitable for input to a controller 52.

Controller 52 may be of any type known in the art for implementing the operations described below. Controller 52 may be located at the grade crossing location 22, such as within a wayside equipment box 24 proximate the grade crossing signal post 10. Controller 52 may include solid-state equipment, relays, microprocessors, software, hardware, firmware, etc. or combinations thereof. Controller 52 includes logic for evaluating sensor signal 48 to determine if annunciator 42 is performing properly. For example, if annunciator 42 is a bell, the sensor 46 may be a microphone placed proximate the bell or a solid-state accelerometer attached to the bell housing or other structure mechanically connected to the bell and vibrating therewith. The signal 48 provided by such a sensor 46 may be processed and recorded by controller 52 to develop information 70 regarding the operating status of annunciator 42. That information 70 may take the form of a simple go/no-go decision wherein proper and improper performances are differentiated. Alternatively, more robust information 70 may be developed depending upon the type of annunciator 42 being monitored and the sophistication of the sensor 46 and logic performed by controller 52. For example, a history of performance data may be recorded with future performance being predicted on the basis of the data trend. For audio performance data, the information 70 may include volume, frequency, and pattern of sound verses time. For visual performance data, the information 70 may include wavelength, intensity and pattern of light verses time. If the annunciator 42 is a level sensor 26 for a swing gate 14, the information 70 may include angle at stop positions and speed of angle change during movement verses time. One may appreciate that the information 70 to be developed would preferably be directly responsive to known failure modes and performance characteristics of the particular type of annunciator 42 being monitored.

Information 70 regarding the performance of annunciator 42 may be developed each time annunciator 42 is energized by operational circuit 44 and/or it may be developed periodically in accordance with a schedule. The schedule of monitoring may, itself, be made responsive to the information 70 in the event that indications of sensor degradation are detected. A special test circuit 72 may be provided to operate the annunciator 42 in a test mode, such as to exercise annunciator 42 in a manner or on a schedule that is not possible with operational circuit 44. To detect possible intermittent failures, data may recorded each time that the annunciator 42 operates, and the schedule of this data may be compared to the schedule of trains passing the grade crossing. An intermittent failure may be identified by an occasional difference between these two schedules. The test circuit 72 may be responsive to the information 48 developed during a previous operation of annunciator 42. For example, should the information 48 be interpreted by controller 52 as indicating the likelihood of a developing problem, the test circuit 72 may be instructed to perform a special test indicative of that developing problem. In one embodiment, a single indication of a malfunctioning annunciator bell may be detected by sensor 46. In order to determine if that single indication was simply spurious information or if it was truly indicative of a real problem with the bell, the test circuit may be instructed by logic resident in controller 52 to produce a rapid series of short bell rings. If the sensor 46 detects proper performance of the bell during each of these rings, the single indication may be deemed to be a spurious indication. Such information may be recorded in memory 53 or other database for future reference in the event of other occurrences of seemingly spurious malfunctions.

Information 70 may be recorded and stored locally in a memory 53 for use by an inspector making periodic visits to the site of the crossing. Advantageously, the information 70 may be communicated to a location remote from the railroad crossing by a communications link 74. The term remote location is used herein to mean a location outside the immediate area of the grade crossing; for example a railway control center located one or many miles from the grade crossing. The remote location may alternatively be a service center having responsibility for inspecting and maintaining the grade crossing warning systems at a plurality of crossings. The remote location to which the information 70 is communicated will be located at a distance from the grade crossing that is greater than that of the approaching train.

Communications link 74 may take any form known in the art, such as a wireless, landline, and/or fiber optic communications device having a transmitter and a remote receiver. Communications link 74 may include and make use of access to the Internet 76 or other global information network. A remote central system controller 78, such as a computerized data processor operated by a railroad or rail crossing service provider, may receive the information 70 from the communications link 74. Information 70 may be received by the system controller 78 regarding a plurality of annunciators 42 at a plurality of crossings within a railroad network. The readiness of grade crossing warning equipment throughout the network may thus be easily and automatically monitored at a central location. Data regarding the make, model, location, installation date, service history, etc. of each annunciator 42 throughout the network may be maintained in a database 84 accessible by the system controller 78. The database 84 may also be updated to include performance information 70 from individual annunciators.

The storage of information 70 in database 84 would permit a trending analysis to be performed on the response of annunciator 42. For example, a change in the time between the delivery of a test signal 54 and the operation of annunciator 42 may be indicative of a developing problem. Early recognition of a change in the system characteristics may permit problems to be fixed before they result in a condition wherein the annunciator 42 fails to respond in a safe manner.

Communications link 74 may include communication equipment located on a passing train 69, so that the information 70 is conveyed from the grade crossing location 22 to the train 69 and then forwarded to a remote location by a transmitter located in the train. The communication to system controller 78 may be routed via the train 69 through a communications transmitter/receiver existing on the train 69 for other purposes. Alternatively, communications link 74 may communicate with up-rail equipment 68 such as a wayside signaling device so that appropriate warnings may be provided to trains 69 on the rail line regarding a malfunction of annunciator 42. Oncoming trains 69 may be signaled to stop or to proceed at a slow speed when an annunciator 42 is not working properly.

Malfunctions of the annunciator 42 may trigger a service request 80 that is forwarded to a maintenance center 82. The maintenance center 82 may be a stationary facility or a mobile repair center or combination thereof for providing equipment and personnel necessary for performing maintenance activities on the grade crossing warning equipment. Maintenance center 82 may also include a database for storing information related to such maintenance activities and data processing equipment for receiving information through the communications link 74 and for taking appropriate action to effect any appropriate maintenance activity related to the service request 80. The system controller 78 may generate the service request 80, or it may be generated as a result of cooperation between the system controller 78 and the maintenance center 82, or it may be generated by the maintenance center 82 alone. The service request 80 is responsive to annunciator-specific information from the database 84 as well as the malfunction-specific information 70. Personnel at the maintenance center 82 may then adequately prepare to accomplish the necessary repair, including the implementation of any equipment upgrades that may be necessary to bring annunciator 42 to current standards. The communication path between the maintenance center 82 and the wayside controller 52 may further be used to interrogate the wayside controller 52 and/or to deliver software of other forms of electronic data and information to the grade crossing equipment. In this manner, software located at a plurality of grade crossings throughout the railroad network may be conveniently upgraded from a central location. Video, audio and graphics links may also be established from the maintenance center 82 to the grade crossing location via this grade crossing equipment monitoring system 40 in order to assist the repairperson in making the necessary repairs and upgrades. An Internet or other multi-media communications link may be especially useful for this application to facilitate convenient access to the information by a plurality of interested parties and to facilitate two-way communication.

An operations center 86 may also receive notification of a malfunctioning annunciator 42. The operations center 86 may be the rail traffic control center for the railroad or other location having equipment and personnel necessary for controlling the operation of trains of a railroad. Upon learning of a malfunctioning annunciator 42, it may be appropriate to divert or slow traffic on certain portions of the rail system. The two-way communication provided by this grade crossing equipment monitoring system 40 may be used to augment the normal traffic control channels available to the railroad for responding to the notification of a failure of a grade crossing annunciator 42.

Figure 3:
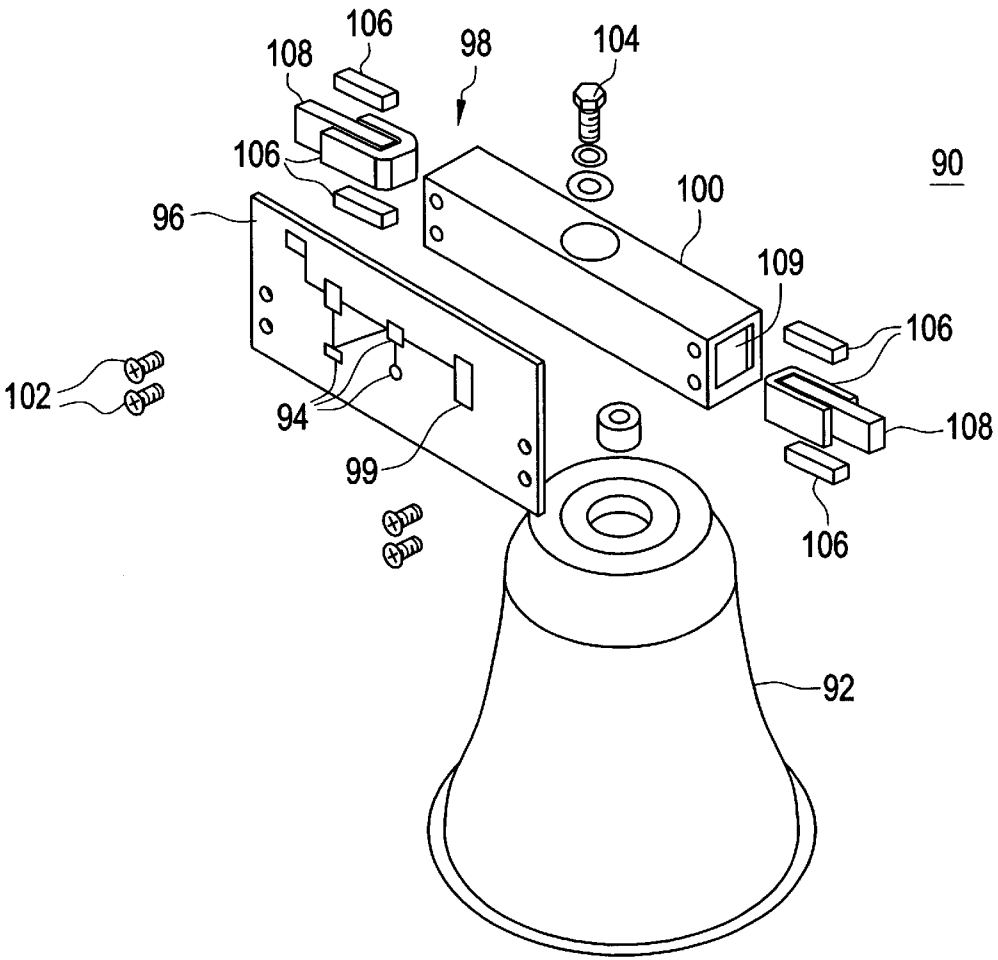
FIG. 3 is an exploded perspective view of an integrated electronic bell sensor system as may be used in the grade crossing warning system of FIG. 2.

FIG. 3 is an exploded perspective view of an integrated electronic bell sensor system 90 as may be used in one embodiment of the grade crossing equipment monitoring system 40. The integrated bell sensor system 90 includes components that perform all or a portion of the functions described with respect to annunciator 42, operational circuit 44, test circuit 72, sensor 46 and signal processor 50. The bell sensor system 90 includes a sound producing device such as a bell or speaker horn 92 such as CSI/Speco model number SPC-8, bell sound emulation circuitry 94 for operating speaker horn 92, a printed circuit board 96 for supporting circuitry 94, and a mounting arrangement 98 for supporting the system 90 on a support structure such as a grade crossing signal post 10. The term bell is used herein to include both traditional mechanical bells and electronic horns that can produce a bell sound. Sensor 46 is a solid-state accelerometer 99 such as Analog Devices part number ADLX105 mounted directly to printed circuit board 96 such as by any known surface mounting process. Circuit board 96 is, in turn, mounted directly to a mounting bracket 100 with fasteners such as screws 102. Speaker horn 92 is also mounted directly to mounting bracket 100 with a fastener such as bolt 104, so that mechanical vibrations created by the operation of speaker horn 92 are transmitted to accelerometer 98. One skilled in the art may appreciate that accelerometer 99 may be mounted at other locations relative to speaker horn 92, but that the use of a solid-state accelerometer 99 mounted directed to the circuit board 96 used for the bell operation circuitry provides an efficient package for field implementation. The mechanical vibration of accelerometer 98 will generate or modulate an electronic signal that may be further processed by circuitry 94 to produce sensor signal 48. As described above, sensor signal 48 may be analyzed to determine if speaker horn 92 is producing a bell sound properly.

In order to isolate accelerometer 99 from mechanical vibrations produced by sources other than horn 92, mounting bracket 100 may be connected to its support structure through a compliant mounting arrangement 98 that includes a plurality of foam strip silicon rubber isolators 106. The rubber isolators 106 are affixed to each side of a pair of metal blocks 108 that are, in turn, solidly connected to the support structure. The mounting bracket 100 is adapted to receive blocks 108 and isolators 106 in respective cavities 109 formed on opposed ends of bracket 100. The support structure (not shown in FIG. 3) may include a housing that is mounted on signal post 10. The isolators 106 serve to mechanically isolate the bell 92 and accelerometer 99 from the support structure at frequencies equal to or greater than the center frequency of the sound produced by horn 92. The isolators 106 also serve to mechanically isolate the horn 92 and accelerometer 99 from mechanical variations of the support structure due to manufacturing tolerances and/or variations in operating temperature.

Figure 4:
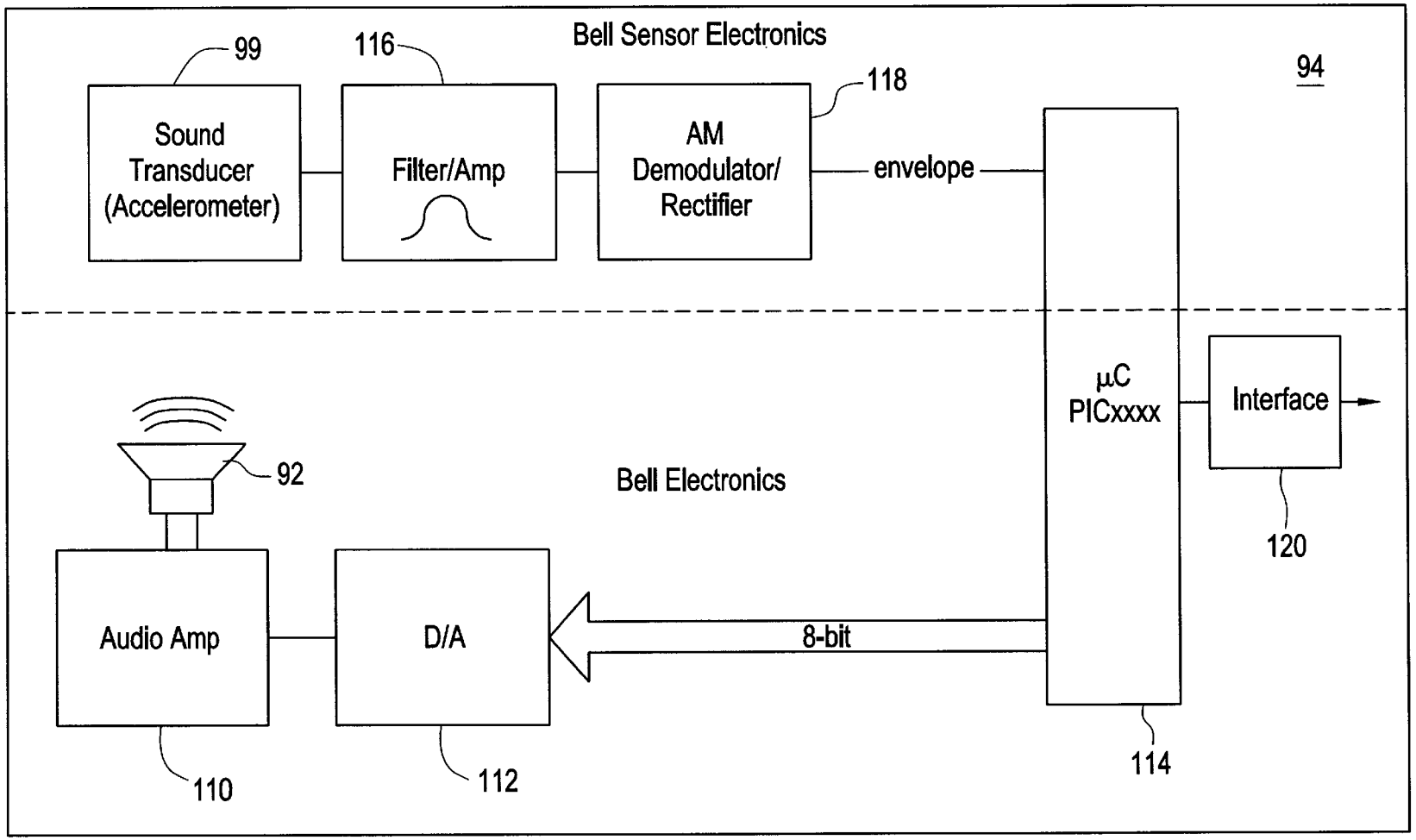
FIG. 4 is a block diagram of the circuitry included in the integrated electronic bell sensor system of FIG. 3.

The functions of circuitry 94 may be more fully appreciated by reference to the block diagram of FIG. 4. Circuitry 94 includes an audio amplifier 110 for powering speaker horn 92. Audio amplifier is responsive to an input signal received from a digital-to-analog converter 112. D/A converter 112 receives instructions from a microcontroller integrated circuit 114 such as Microchip model number PIC16F73 containing logic for both the bell and bell sensor functions. Accelerometer 99 is also connected to integrated circuit 114 through signal processor 50 including a filter/amplifier circuit 116 and an AM demodulator/rectifier circuit 118. An interface device 120 connects the circuitry 94 to remote devices such as a recorder, microprocessor, communications device, etc.

While the preferred embodiments of the present invention have been shown and described herein, it will be obvious that such embodiments are provided by way of example only. Numerous variations, changes and substitutions will occur to those of skill in the art without departing from the invention herein. For example, other types of wayside equipment may be monitored in the manner described herein. Switches, signaling equipment and vehicle detection equipment may each be provided with appropriate sensors, signal processing, and communication equipment for remote monitoring and reporting. Accordingly, it is intended that the invention be limited only by the spirit and scope of the appended claims.

We claim as our invention:

1. Apparatus for monitoring railroad grade crossing warning equipment, the apparatus comprising:

circuitry for activating an annunciator at a grade crossing location in response to the approach of a train;

a sensor for generating a signal responsive to the operation of the annunciator; circuitry responsive to the signal for generating information representing an operating status of the annunciator; and a communicating link for communicating the information to a location remote from the grade crossing, wherein the annunciator comprises a sound producing device, and wherein the sensor comprises an accelerometer.

2. The apparatus of claim 1, further comprising:

a mounting bracket attached to the sound producing device;

a circuit board attached to the mounting bracket and including circuitry for operating the sound producing device;

the accelerometer being attached to the circuit board;

signal processing circuitry associated with the accelerometer mounted on the circuit board; and a mounting device for attaching the mounting bracket to a support and for providing isolation at frequencies equal to or greater than a center frequency of sound produced by the sound producing device.

3. Apparatus for monitoring railroad grade crossing warning equipment, the apparatus comprising:

circuitry for activating an annunciator at a grade crossing location in response to the approach of a train;

a sensor for generating a signal responsive to the operation of the annunciator;

circuitry responsive to the signal for generating information representing an operating status of the annunciator; and a communications link for communicating the information to a location remote from the grade crossing, further comprising:

a database for receiving and storing the information; and a data processor associated with the database for processing the information.

4. The apparatus of claim 3, wherein the annunciator comprises a light, and wherein the sensor comprises a photo sensor.

5. The apparatus of claim 3, wherein the annunciator comprises a swing gate, and wherein the sensor comprises a position sensor.

6. The apparatus of claim 3, wherein the communications link comprises a two-way communication device for further communicating from the remote location to the grade crossing location.

7. The apparatus of claim 3, wherein the communications link comprises a receiver located on the train.

8. The apparatus of claim 3, wherein the communications link further comprises a multi-media information network.

9. Apparatus for monitoring railroad grade crossing warning equipment the apparatus comprising:

circuitry for activating an annunciator at a grade crossing location in response to the approach of a train;

a sensor for generating a signal responsive in the operation of the annunciator;

circuitry responsive to the signal for generating information representing an operating status of the annunciator; and a communications link for communicating the information to a location remote from the grade crossing;

further comprising a test circuit for selectively operating the annunciator in a test mode independent of the approach of a train.

10. The apparatus of claim 9, wherein the test circuit is responsive to the information.

11. Apparatus for monitoring railroad grade crossing warning equipment, the apparatus comprising:

circuitry for activating an annunciator at a grade crossing location in response to the approach of a train;

a sensor for generating a signal responsive to the operation of the annunciator;

circuitry responsive to the signal for generating information representing an operating status of the annunciator; and a communications link for communicating the information to a location remote from the grade crossing;

further comprising a maintenance center connected to the communications link for receiving the information ion.

12. Apparatus for monitoring railroad grade crossing warning equipment, the apparatus comprising:

circuitry for activating an annunciator at a grade crossing location in response to the approach of a train;

a sensor for generating a signal responsive to the operation of the annunciator;

circuitry responsive to the signal for generating information representing an operating status of the annunciator; and a communications link for communicating the information to a location remote from the grade crossing;

further comprising an operations center connected to the communications link for receiving the information.

13. An apparatus for monitoring a railroad grade crossing warning bell, the apparatus comprising:

an accelerometer mechanically coupled to a railroad crossing warning bell for receiving mechanical vibrations produced by the bell and for producing a signal responsive to the vibrations; and a controller for receiving the signal and for developing information regarding an operating status of the bell.

14. The apparatus of claim 13, further comprising:

a mounting bracket attached to the bell;

a circuit board attached to the mounting bracket and including circuitry for operating the bell;

the accelerometer being attached to the circuit board;

signal processing circuitry associated with the accelerometer mounted on the circuit board; and a mounting device for attaching the mounting bracket to a support and for providing isolation at frequencies equal to or greater than a center frequency of sound produced by the bell.

15. The apparatus of claim 13, further comprising a communications link connected to the controller for transmitting the information to a remote location.

16. The apparatus of claim 15, wherein the communications link comprises a multi-media communications network.

17. The apparatus of claim 15, wherein the communications link comprises a two-way communication device for further communicating from the remote location to a grade crossing location.

18. The apparatus of claim 15, wherein the communications link comprises a receiver located on a train.

19. The apparatus of claim 15, further comprising a maintenance center connected to the communications link for receiving the information.

20. The apparatus of claim 15, further comprising an operations center connected to the communications link for receiving the information.

21. The apparatus of claim 13, further comprising a test circuit for operating the bell in a test mode.

22. The apparatus of claim 21, wherein the test circuit is responsive to the information.

23. The apparatus of claim 13, further comprising: a database fur receiving and storing the information; and a data processor associated with the database for processing the information.

24. A method of monitoring the operational status of an annuciator for railway grade crossing warning equipment, the method comprising:

sensing the operation of an annuciator at a grade crossing location;

generating a signal responsive to the operation of the annunciator;

processing the signal to produce information indicative of an operating status of the annuciator; and transmitting the information to a location remote from the grade crossing location.

25. The method of claim 24, further comprising communicating the information via a multi-media communication network.

26. The method of claim 24, further comprising comparing the information to data stored in a database located remote from the grade crossing location.

27. The method of claim 24, further comprising exercising the annunciator with a test circuit to produce the information.

28. The method of claim 24, further comprising communicating from the remote location to the grade crossing location via a communication path used to communicate the information to the remote location.

* * * * *